US006324350B1

(12) United States Patent
Ito et al.

(10) Patent No.: US 6,324,350 B1
(45) Date of Patent: Nov. 27, 2001

(54) REUSABLE UNIT DISPLAYING A SPECIFIC PATTERN AND AN IMAGE FORMING APPARATUS USING THE REUSABLE UNIT WHEN THE SPECIFIC PATTERN IS DISPLAYED AND RENDERING THE SPECIFIC PATTERN ILLEGIBLE WHEN THE REUSABLE UNIT IS EXHAUSTED

(75) Inventors: Kenzo Ito, Kodaira; Kazutami Noguchi, Hamura; Kenji Kobayashi, Akiruno; Masayuki Ikeda, Kawaguchi; Kenji Igarashi, Tokyo, all of (JP)

(73) Assignees: Casio Computer Co., Ltd., Tokyo; Casio Electronics Manufacturing Co., Ltd., Saitama-ken, both of (JP)

( * ) Notice: Subject to any disclaimer, the term of this patent is extended or adjusted under 35 U.S.C. 154(b) by 0 days.

(21) Appl. No.: 09/459,869

(22) Filed: Dec. 13, 1999

(30) Foreign Application Priority Data

Dec. 25, 1998 (JP) ..... 10-368704
May 28, 1999 (JP) ..... 11-150301

(51) Int. Cl.[7] ..... G03G 15/00
(52) U.S. Cl. ..... 399/12; 399/24
(58) Field of Search ..... 399/12, 25, 24

(56) References Cited

U.S. PATENT DOCUMENTS

| | | | |
|---|---|---|---|
| 4,963,939 | 10/1990 | Kurando ey al. . | |
| 5,084,143 | 1/1992 | Smith . | |
| 5,184,181 | 2/1993 | Kurando et al. . | |
| 5,758,224 | 5/1998 | Binder et al. . | |
| 5,761,566 | 6/1998 | Suzuki et al. | 399/12 |
| 5,771,420 | 6/1998 | Suzuki et al. | 399/25 |

FOREIGN PATENT DOCUMENTS

| | | |
|---|---|---|
| 0 261 643 | 3/1988 | (EP) . |
| 0 831 379 | 3/1998 | (EP) . |
| 2-061656 | 3/1990 | (JP) . |
| 3-039983 | 2/1991 | (JP) . |
| 4-134380 | 5/1992 | (JP) . |
| 5-265274 | 10/1993 | (JP) . |
| 7-036348 | 2/1995 | (JP) . |
| 8-224947 | 9/1996 | (JP) . |
| 9-281860 | 10/1997 | (JP) . |
| 11-231734 | 8/1999 | (JP) . |

*Primary Examiner*—Quana M. Grainger
(74) *Attorney, Agent, or Firm*—Frishauf, Holtz, Goodman, Langer & Chick, P.C.

(57) ABSTRACT

An identification label is affixed on a top surface of an image forming unit which is detachably installed in a main component of an image forming apparatus. The identification label is made of a thermosensitive paper on which a trademark logo is printed. A logo reader in the main component reads a pattern of the logo mark on the identification label. A control unit compares the read logo pattern with a previously stored pattern to discriminate whether the read logo mark is genuine or not. If the identification label has the genuine logo mark, the control unit executes printing. If the identification label has an irregular logo mark, printing is abandoned and an error message is displayed. When a genuine image forming unit is exhausted, the control unit controls a heating device to apply heat to the identification label in order to wholly or partially discolor the identification label so that the logo mark is transformed to unreadable one. That unit will be regarded as an irregular one thereafter. For authorized activity for reusing such treated unit, a newly prepared genuine label is affixed to the once exhausted image forming unit after refilling toner or replacing a photoconductor drum is done.

20 Claims, 9 Drawing Sheets

REUSABLE UNIT DISPLAYING A SPECIFIC PATTERN AND AN IMAGE FORMING APPARATUS USING THE REUSABLE UNIT WHEN THE SPECIFIC PATTERN IS DISPLAYED AND RENDERING THE SPECIFIC PATTERN ILLEGIBLE WHEN THE REUSABLE UNIT IS EXHAUSTED

BACKGROUND OF THE INVENTION

1. Field of the Invention

The present invention relates to an image forming apparatus such as a printer which forms images using a reusable unit containing expendable materials such as toner, ink or a photoconductive material, and more particularly to a reusable unit and an image forming apparatus using the reusable unit which realize less emission of wastes and excellent imaging quality.

2. Description of the Related Art

An electrophotographic image forming apparatus (such as a laser printer, a copying machine) has been known as an apparatus for forming images using toner. Such a image forming apparatus generally comprises a photoconductive unit and an image developing unit each of which is detachably installed in a main component of an image forming apparatus. The photoconductive unit comprises a photoconductive element on which electrostatic latent images are formed. The image developing unit develops the electrostatic latent images.

Generally, the photoconductive unit is replaced with a new one and dumped when the photoconductive element no longer works. The image developing unit is also replaced with a new one and damped when the toner in it is fully exhausted. The new unit is usually supplied by the manufacturer of the image forming apparatus.

Because such units are expendable, not only the manufacturer of the image forming apparatus but also third parties produce such the units. Since those units produced by the third parties are not genuine products, some of them have crude quality which may damage the image forming apparatus.

As described above, those units are designed as expendable products to be dumped. However, some of the wasted units have been resold for reuse nowadays. The resellers collect the wasted units and refill toner in the image developing unit or replace the photoconductive element in the photoconductive unit.

Such reselling activity is helpful for less emission of wastes. However, the toner to be refilled or the photoconductive element to be replaced is not a genuine product because they are produced by third parties. That is, some of the resold products have crude quality like the above mentioned copy products. The crude quality of the resold units may cause quality deterioration of resultant images. Moreover, the image forming apparatus may be damaged by scattered toner, irregularly remaining toner on a fixing roller, and the like. In practice, it is difficult to judge whether such problems are caused by the image forming apparatus or the non-genuine unit installed therein.

If the cause of the problem is unknown, it is unclear who should take responsibility for the problem. In such a case, the manufacturer of the image forming apparatus has no means to solve the problem. And if the problem remains unsolved, and similar problems occur in following products, users may come to believe that the image forming apparatus itself is the cause of the problem. Such a misunderstanding may affect the manufacturer's reputation.

U.S. Pat. No. 5,761,566 discloses a technique which inhibits an irregular cartridge from being used. According to the disclosure in this patent, an uneven patterned logo mark is formed on a surface of a cartridge which contains expendable material. The logo mark is incorporated with a resin frame. And detection switches are provided in an image forming device to detect projected portions of the logo mark, so that it can be determined whether the cartridge is genuine or not.

However, manufacturing such a cartridge is expensive because forming such a logo mark is complex work. Moreover, the disclosed technique will be helpful for inhibiting the above mentioned copy products from being used, however, it is not effective in preventing use of the reused products, because they use genuine cartridges whose contents are replaced. As a result, problems caused by such reused products will be unsolved.

SUMMARY OF THE INVENTION

It is an object of the present invention to provide a reusable unit and an image forming apparatus using the reusable unit which realizes less emission of wastes and eliminates disadvantageous matters such as image quality deterioration.

To accomplish the above object of the present invention, a reusable unit according to the present invention is detachably installable in an image forming apparatus main component and includes expendable elements to be exhausted by image forming. The reusable unit comprises:

a displaying medium on which a predetermined pattern is displayed, wherein a material of the displaying medium is able to cause illegibleness of the specific pattern with externally supplied energy.

In the thus structured reusable unit according to the present invention, the displaying medium causes illegibleness of the specific pattern when energy is supplied from the image forming apparatus main component.

The above described reusable unit according to the present invention may further comprise a pattern processor which causes illegibleness of the specific pattern displayed on the displaying medium based on a signal supplied from the image forming apparatus main component.

In the above described reusable unit according to the present invention, it is preferable that the displaying medium is discolored with applied heat to cause illegibleness of the specific pattern. The displaying medium may be discolored when electricity is applied into the displaying medium or when charges are applied onto the displaying medium to cause illegibleness of the specific pattern.

In the above described reusable unit according to the present invention, it is preferable that the specific pattern represents a trademark.

To also accomplish the above object of the present invention, an image forming apparatus according to the present invention is an image forming apparatus in which the reusable unit having expendable elements to be exhausted by image forming is detachably installed, wherein the reusable unit comprises a displaying medium on which a specific pattern to be illegible by externally supplied energy is printed, and the image forming apparatus comprises:

a pattern processor for causing illegibleness of the specific pattern printed on the displaying medium by supplying the energy to the displaying medium;

a reader for reading the specific pattern printed on the displaying medium; and a control unit for determining whether the specific pattern read by the reader coincides with a predetermined pattern, and for allowing the image forming apparatus to execute image forming when the read specific pattern represents the predetermined pattern.

The thus structured image forming apparatus according to the present invention may comprise a life detector for determining whether a life of the reusable unit remains or not, wherein the control unit activates the pattern processor when the life detector determines that the life of the reusable unit does not remain.

In the above described image forming apparatus according to the present invention, it is preferable that a material of the displaying medium is discolored with externally supplied heat so as to cause illegibleness of the specific pattern, and the pattern processor is a heating device which applies thermal energy to the displaying medium. The displaying medium may be discolored when electricity is applied into said displaying medium to cause illegibleness of the specific pattern, and the pattern processor may be an electricity supplier which applies the electricity into the displaying medium, or the displaying medium may be discolored when charges are applied onto the displaying medium to cause illegibleness of the specific pattern, and the pattern processor may be a discharging device which applies the charges onto the displaying medium.

In the above described image forming apparatus according to the present invention, it is preferable that the specific pattern represents a trademark.

To also accomplish the above object of the present invention, an image forming apparatus according to the present invention is an image forming apparatus in which a reusable unit having expendable elements to be exhausted by image forming is detachably installed, wherein the reusable unit comprises a displaying medium on which a specific pattern to be illegible by externally supplied energy is printed and a pattern processor which causes illegibleness of the specific pattern printed on the displaying medium by supplying the energy, and the image forming apparatus comprises:

a reader for reading the specific pattern printed on the displaying medium; and a control unit for determining whether the specific pattern read by the reader coincides with a predetermined pattern, and for allowing the image forming apparatus to execute image forming when the read specific pattern represents the predetermined pattern.

The thus structured image forming apparatus according to the present invention may comprise a life detector for determining whether a life of the reusable unit remains or not, wherein the control unit activates the pattern processor when the life detector determines that the life of the reusable u nit does not remain.

In the above described image forming apparatus according to the present invention, it is preferable that a material of the displaying medium is discolored with externally supplied heat so as to cause illegibleness of the specific pattern, and the pattern processor is a heating device which applies thermal energy to the displaying medium. The displaying medium may be discolored when electricity is applied into the displaying medium to cause illegibleness of the specific pattern, and the pattern processor may be an electricity supplier which applies the electricity into the displaying medium, or the displaying medium may be discolored when charges are applied onto the displaying medium to cause illegibleness of the specific pattern, and the pattern processor may be a discharging device which applies the charges onto the displaying medium.

In the above described image forming apparatus, it is preferable that the specific pattern represents a trademark.

To also accomplish the above described object of the present invention, an image forming apparatus according to the present invention is an image forming apparatus in which a reusable unit having expendable elements to be exhausted by image forming is detachably installed, wherein the reusable unit comprises a displaying medium on which a specific pattern is printed, and the image forming apparatus comprises:

a pattern processor for causing illegibleness of the specific pattern printed on the displaying medium by applying pigment onto the specific pattern;

a reader for reading the specific pattern printed on the displaying medium; and a control unit for determining whether the specific pattern read by the reader coincides with a predetermined pattern, and for allowing the image forming apparatus to execute image forming when the read specific pattern represents the predetermined pattern.

The thus structured image forming apparatus according to the present invention may comprise a life detector for determining whether a life of the reusable unit remains or not, wherein the control unit activates the pattern processor when the life detector determines that the life of said reusable unit does not remain.

In the above described image forming apparatus according to the present invention, the pattern processor may be a stamper which applies the pigments onto the specific pattern printed on the displaying medium.

In the above described image forming apparatus according to the present invention, it is preferable that the specific pattern represents a trademark.

According to the present invention, the image forming apparatus discriminates whether the installed reusable unit is genuine or not based on the specific pattern printed on the displaying medium. In addition, a displaying medium on a once exhausted unit is rendered to have illegible pattern. And, if a trademark logo is employed as the specific pattern, third parties are substantially inhibited to irregularly copy the reusable units, refill/replace expendable materials to irregularly produce a reused unit, and merchandize such irregularly reused units. As a result, irregularly reused units with crude quality causing image quality deterioration, etc. will be eliminated from the market, and the image forming apparatus and its manufacturer gain consumer confidence.

Moreover, according to the features of the present invention the manufacturer of the image forming apparatus can easily identify whether a once exhausted reusable unit is a genuine product (manufacturer's genuine made or a licensed product) or not. Such identification helps the manufacturer to promote proper recycle/reuse activities for less waste emission.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Preferred embodiments of the present invention will now be described with reference to accompanying drawings.

Figure 1A:
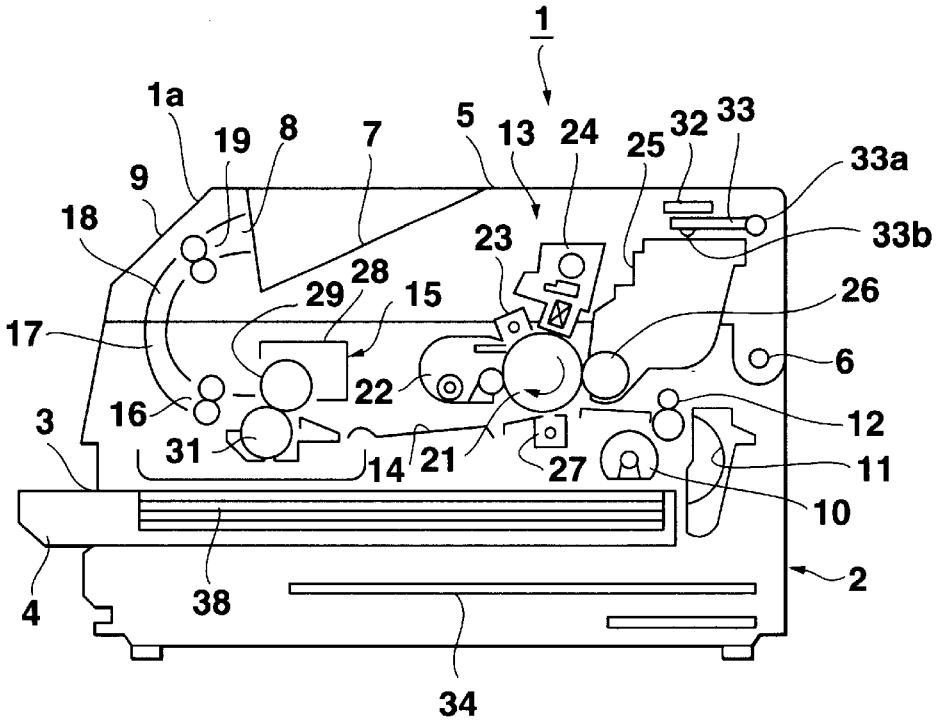
FIG. 1A is a cross sectional view showing the whole structure of an image forming apparatus according to one embodiment of the present invention.
Figure 1B:
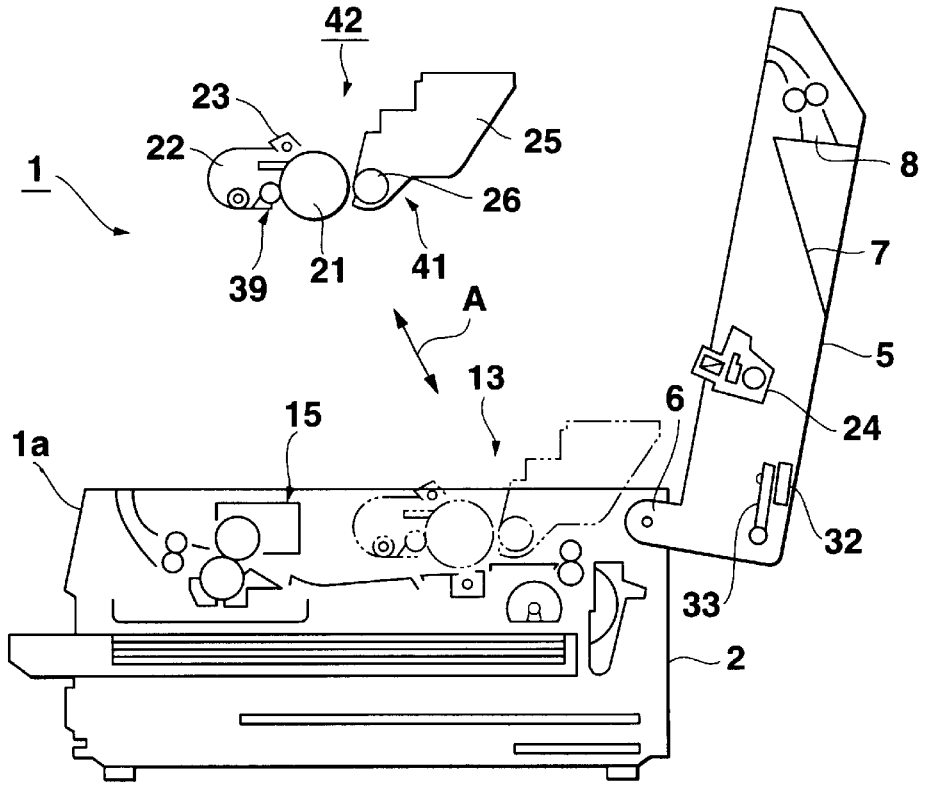
FIG. 1B is a diagram showing the image forming apparatus shown in FIG. 1A when its upper cover is opening for removing/installing an image forming unit.

FIG. 1A shows the whole structure of an image forming apparatus according to one embodiment of the present invention. FIG. 1B shows a state where an upper cover of the image forming apparatus shown in FIG. 1A is opening for removing or installing an image forming unit which is provided as a reusable unit according to one embodiment of the present invention.

An image forming apparatus 1 shown in FIG. 1A is an electrophotographic printer. A lower component 2 of the image forming apparatus 1 has a front-lower-end opening 3. A detachable paper cassette 4 is inserted in the image forming apparatus through the front-lower-end opening 3. A main component 1*a* has an upper cover 5 on its upper portion. The upper cover 5 slopes to front of the image forming apparatus 1 (slopes leftward in FIG. 1A) so as to form an output tray 7. A paper outlet 8 is provided on a front wall of the output tray 7. A slant surface 9 is formed at front end of the upper cover 5, and it comprises a control panel on which a power switch, a liquid crystal display, warning lamps, a plurality of input keys, and the like are provided.

In the main component 1*a,* a paper feeding roller 10 above a paper-feeding end (right end in FIG. 1A) of the paper cassette 4 is provided. A paper guide 11 is provided beside the paper feeding roller 10, and a pair of rollers 12 for pulling a sheet of paper from the paper guide 11 is arranged above the paper guide 11. In the direction from the rollers 12 (the start end) to the paper outlet 8 (the finish end), an image forming section 13, a paper guiding path 14, a fixing section 15, a pair of rollers 16 for pulling the sheet of paper from the fixing section 15, a paper guiding path 17 (in the lower component 2), a paper guiding path 18 (in the upper cover 5), and a pair of rollers 19 for leading the sheet of paper to the paper outlet 8 are provided. The image forming section 13, the paper guiding path 14 and the fixing section 15 are arranged above the paper cassette 4 in the longitudinal direction of it.

The image forming section 13 comprises a photoconductor drum 21, a cleaner 22 arranged around the photoconductor drum 21, a charger 23, an optical writing head 24, a toner hopper 25, a developing roller 26, and a transfer device 27.

As shown in FIG. 1B, a drum unit 39, which is one of reusable units, comprises the photoconductor drum 21, the cleaner 22 and the charger 23 as an assembly part with a support frame. As shown in FIG. 1B, the developing roller 26 is rotatably built in the toner hopper 25 at a lower opening thereof. The pair of the toner hopper 25 and the developing roller 26 forms a developing unit 41 which is the other reusable unit. And further a pair of the drum unit 39 and the developing unit 41 forms an image forming unit 42. The image forming unit 42 is detachably installed in the main component 1*a.* An arrow A in FIG. 1B indicates the way to install/remove the image forming unit 42 in/from the image forming section 13 while the upper cover 1*a* is opening. The optical writing head 24 is suspended on the upper cover 5 and the transfer device 27 is suspended on a frame in the lower component 2.

The fixing section 15 comprises a thermal roller 29 housed in an insulation cabinet and a press roller 31 for pressing the thermal roller 29.

On the inside surface of the upper cover 5, a logo reader 32 and a heating device 33 are arranged near the rear end of the upper cover 5. The logo reader 32 is a sensor which reads a trademark logo (logo mark) printed and displayed on an identification label (described later) affixed on an upper surface of the toner hopper 25. The heating device 33 transforms the logo mark to unreadable (illegible) one. The heating device 33 comprises an arm which is swingable being pivoted on a shaft 33*a,* and a heater 33*b* arranged on a movable end of the arm. The heater 33*b* will contact the identification label on the toner hopper by the arm's movement. For example, a thermal head, which is usually employed in a thermal printer, is applicable as the heating device 33.

A circuit unit 34 is provided under the paper cassette 4. Installed in the circuit unit 34 are circuit boards on which a plurality of electronic parts forming a control unit, its peripheral circuits, and the like are formed.

Figure 2:
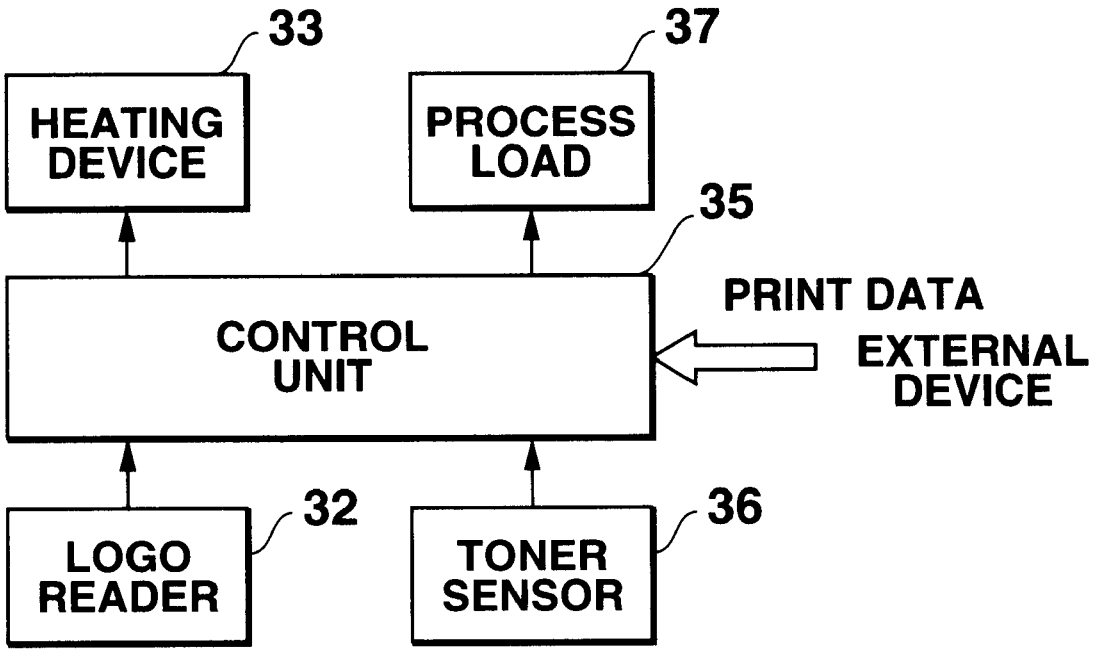
FIG. 2 is a block diagram showing a control unit and its peripheral circuits provided in a circuit unit in the image forming apparatus according to one embodiment of the present invention.

FIG. 2 is a block diagram showing the control unit and its peripheral circuits included in the circuit unit of the image forming apparatus according to one embodiment of the present invention. Primal sections of a control unit 35 are a controller and an engine. The controller of the control unit 35 has a CPU (Central Processing Unit). The CPU executes predetermined programs to control all sections in the main component 1*a*. The controller receives, for example, print data from an external device such as a personal computer, and signals from the logo reader 32 and a toner sensor 36. The engine controls the heating device 33 and a process load 37 in accordance with an instruction from the controller. The process load 37 is a paper transfer mechanism including the image forming section 13, the fixing section 15, and rollers 10, 12, 16 and 19.

A printing operation in the image forming apparatus 1 will now be described. The image forming apparatus 1 is powered on, and instructions such as the number of print pages are input to the control unit 35 from the input keys on the control panel or a host device such as a personal computer via a connection cable or the like. Upon the receipt of the instructions, the control unit 35 drives the image forming section 13 and the fixing section 15 of the process load 37. Then the control unit 35 controls the paper feeding roller 10 in accordance with a printing timing, to pull a top sheet of paper 38 stocked in the paper cassette 4, and lead it to the rollers 12 via the paper guide 11. The roller 12 leads the sheet 38 to the image forming section 13 under a control of the control unit 35.

In the image forming section 13 driven by the control unit 35, the photoconductor drum 21 rotates in the clockwise direction in FIG. 1A. The charger 23 applies charges to a round surface of the photoconductor drum 21 uniformly. The optical writing head 24 exposes the round surface of the photoconductor drum 21 in accordance with signals of the image data. Thus, high potential portions caused by the charges applied by the charger 23 and low potential portions caused by the exposure which attenuates the charges are formed on the round surface of the photoconductor drum 21, and these high and low potential portions form an electrostatic latent image. The developing roller 26 transfers toner supplied by the toner hopper 25 to the low potential portions of the electrostatic latent image formed on the round surface of the photoconductor drum 21. Thus, a toner image is formed (developed) on the round surface of the photoconductor drum 21.

The rollers 12 forwards the sheet 38 so that a top end of the toner image on the round surface of the photoconductor drum 21 meets a print start position on the sheet 38 at a position of the toner transfer device 27. The sheet 38 is continuously led by the rollers 12, and the photoconductor drum 21 continues its rotation. The toner transfer device 27 discharges to form an electric field between the toner transfer device 27 and the photoconductor drum 21. The formed electric field causes the toner image on the round surface of the photoconductor drum 21 to be sequentially transferred to the sheet 38. The cleaner 22 removes the remained toner on the photoconductor drum 21 after the image transfer is completed.

The rollers 12 further forwards the sheet 38 on which the toner image is transferred to the fixing section 15. In the fixing section 15, the sheet 38 is sandwiched by the thermal roller 29 and the press roller 31. Heat and pressure given by the thermal roller 29 and the press roller 31 fix the transferred toner image to the sheet 38. Then the sheet 38 is pulled by the rollers 16 to be led to the guides 17 and 18, and finally the rollers 19 leads the sheet 38 to the paper outlet 8. As a result, the sheet 38 is output on the output tray 7 so that the imaged side faces the output tray 7.

Figure 3A:
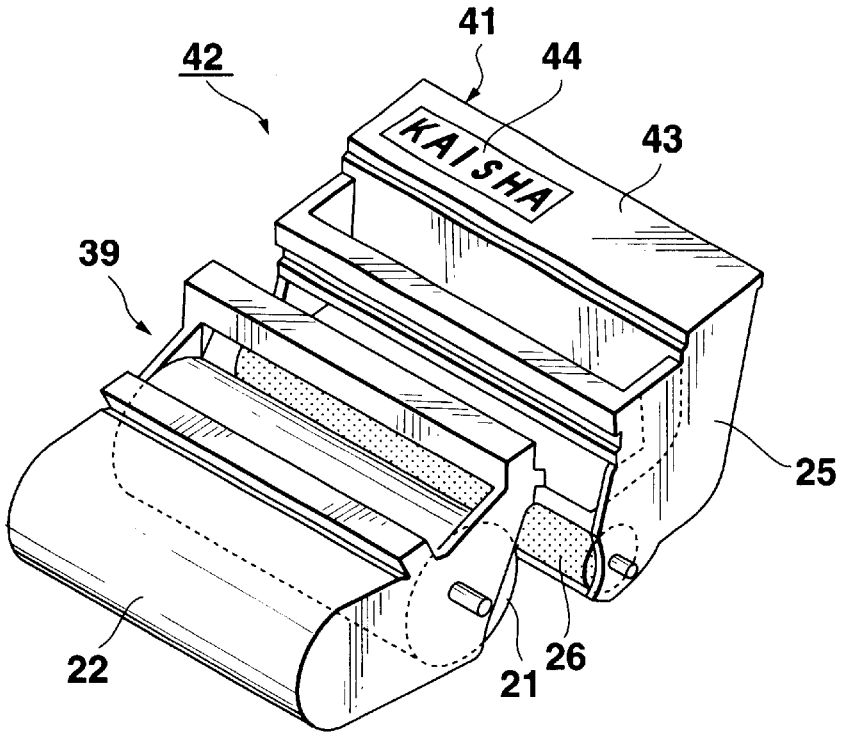
FIG. 3A is a perspective view showing a reusable unit according to one embodiment of the present invention.
Figure 3B:
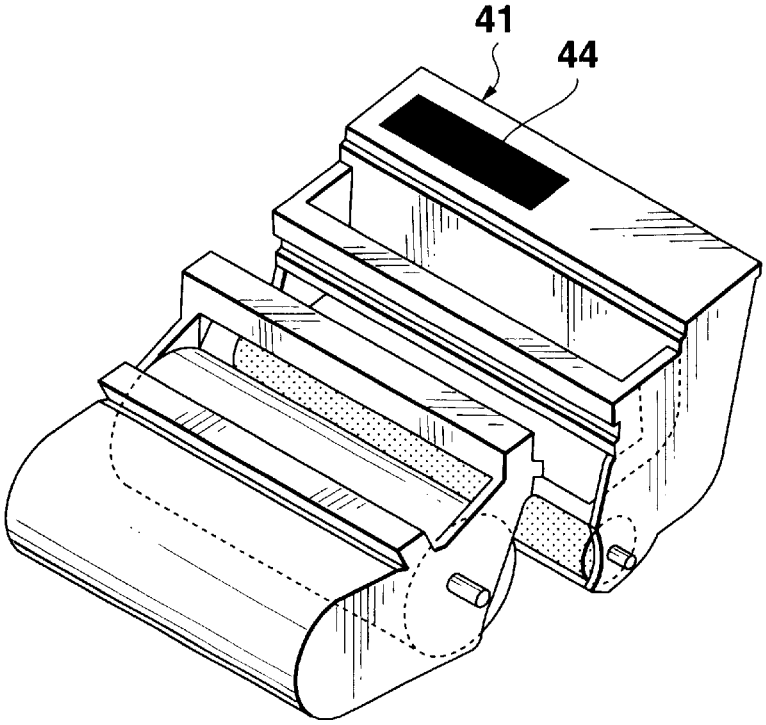
FIG. 3B is a diagram showing a state where an identification label on the reusable unit shown in FIG. 3A is discolored, thus a trademark logo on the identification label becomes unreadable.

FIG. 3A is a perspective view showing the image forming unit 42 removed from the main component 1*a*. As illustrated, an identification label 44 is affixed on the developing unit 41 of the image forming unit 42. A trademark logo (logo mark) "KAISHA" is printed on the identification label 44. The identification label 44 will be, for example, wholly discolored by thermal energy applied by the heating device 33, as shown in FIG. 3B. Thus, the logo mark "KAISHA" will be unreadable. The identification label 44 may be partially discolored, for example, an area in a frame corresponding to only one character may be discolored, for transforming the logo mark to an irregular logo.

In a preferable embodiment shown in FIGS. 1A, 1B and 2, the identification label 44 is made of a thermosensitive paper which will be blacked out (discolored) by the thermal energy given by the heating device 33. However, the material of the identification label 44 is not limited to the thermosensitive paper. For example, a material whose appearance is transformed in accordance with an applied electricity in the material or a material whose appearance is transformed in accordance with charges applied onto the material may be applicable. In a case where such the material is used, an electricity supplier or a discharge device may be employed in the main component 1 a instead of the heating device 33. Or, in a case where a material whose appearance is transformed by an applied ultraviolet ray in a predetermined wavelength range, the main component la may have a device which emits such the ultraviolet ray instead of the heating device 33. In conclusion, an applicable material for the identification label 44 is one whose appearance is transformed by externally applied energy, so that the printed logo mark becomes unreadable.

Figure 4A:
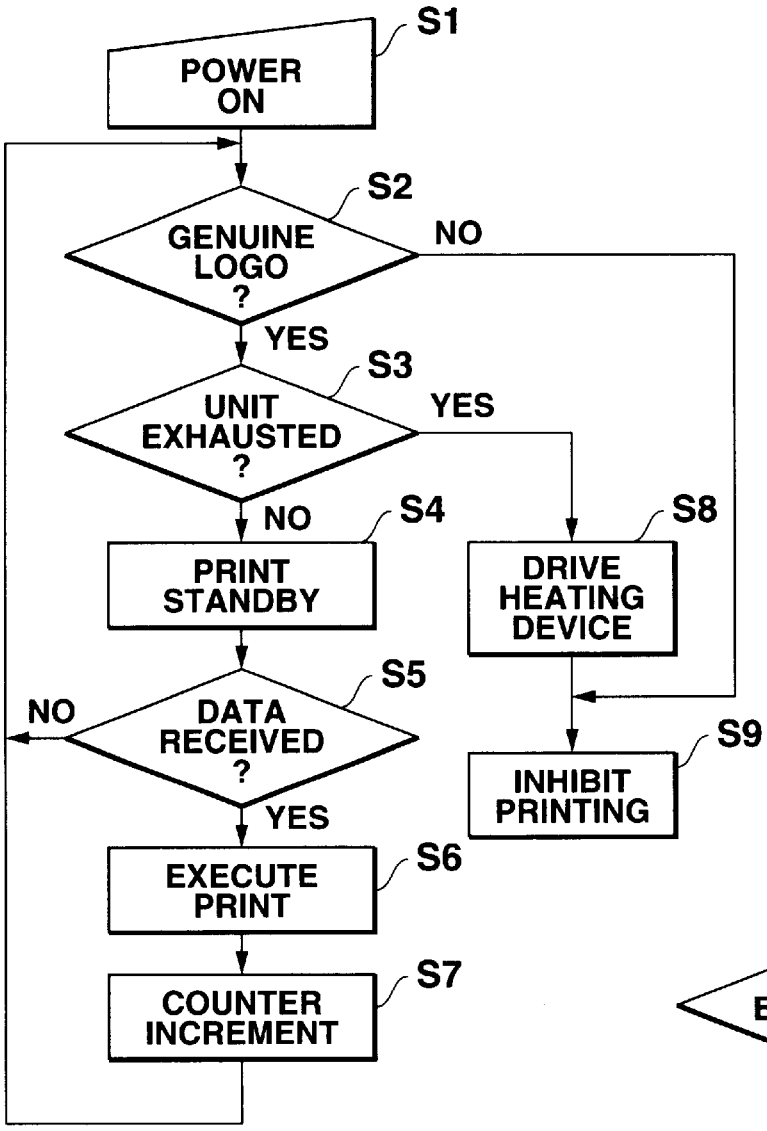
FIG. 4A is a flowchart showing the steps executed by the control unit shown in FIG. 2.
Figure 4B:
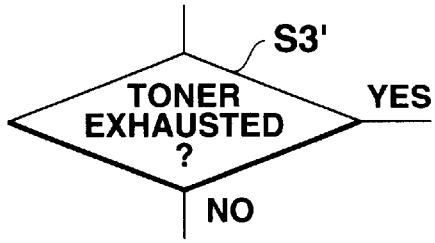
FIG. 4B is a diagram showing an optional step applicable to the flowchart shown in FIG. 4A.

FIG. 4A is a flowchart showing the steps executed by the control unit 35. FIG. 4B is a diagram showing an optional step applicable to the process flow shown in FIG. 4A. In FIG. 4A, a user turns on the power switch on the control panel to activate the main component 1*a* (step S1).

After the main component 1*a* is activated, the control unit 35 controls the logo reader 32 to read the logo mark on the identification label 44. And the control unit 35 compares the read logo mark with a logo mark "KAISHA" which is previously registered in the control unit 35 to discriminate whether the read logo mark is authorized one or not (step S2).

If the read logo mark is regarded as the authorized mark (result of step S2 is "YES"), the control unit 35 determines whether the life of the image forming unit 42 remains or not (step S3). The determination is based on a count value of print pages since the image forming unit was newly installed to the last printing. More precisely, the control unit 35 determines whether the count value reaches a predetermined value or not. In this case, the predetermined value is defined based on, for example, the maximum number of printable pages corresponding to durability of the photoconductor drum 21 of the drum unit 39. The counter value will be increased by step S7 (described later), therefore, the control unit 35 reads the counter value so far.

If the counter value does not reach the predetermined value (result of step S3 is "NO"), the control unit 35 sets any sections of the process load 37 to print standby mode (step S4). The control unit 35 determines whether print data has been supplied from the external device or not (step S5).

If the print data has not been supplied (result of step S5 is "NO"), the flow returns to step S2, and the control unit 35 executes steps S2 to S5 repeatedly. If the print data has been supplied (result of step S5 is "YES"), the control unit 35 controls the process load 37 to execute the aforementioned printing operation (step S6). After the control unit 35 increases the counter by 1 (step S7), the flow returns to step S2.

That is, the control unit 35 executes step S2 each time the printing is finished to discriminate whether the logo mark on the identification label 44 is authorized one or not. Therefore, if the genuine image forming unit 42, that is, the image forming unit having the genuine identification label 44, is replaced with an irregular one, the control unit 35 recognize it in step S2. In order to count the cumulative total of the print pages correctly, the counter value is reset when the image forming unit 42 is renewed, or when the heating device 33 is driven in step S8 (described later).

If the counter value reaches the predetermined value in step S3, the control unit 35 determines that the photoconductor drum 21 no longer works (result of step S3 is "YES") and drives the heating device 33 so that the identification label 44 is wholly blacked out as shown in FIG. 3B (step S8). Then the flow goes to step S9 (described later). The control unit 35 also controls the liquid crystal display to display a message saying that the image forming unit 42 has been exhausted.

In step S8, the heating device 33 may be controlled so that the identification label 44 is partially blacked out, for example, only an area in a frame corresponding to one character may be blacked out. Even if the identification label 44 is partially transformed, the control unit 35 determines in step S2 that the identification label 44 is irregular one. In such the case, the image forming unit 42 having the transformed label is no longer used unless the authorized genuine identification label 44 is given. This limitation is effective even when the toner is refilled or the photoconductor drum is replaced.

If the control unit 35 determines in step S2 that the read logo mark is not the genuine one (result of step S2 is "NO") after the identification label 44 is blacked out in step S8, the control unit 35 recognizes that the image forming unit 42 being installed in the main component 1*a* is not appropriate one. The control unit 35 executes predetermined print inhibition process and terminates the process flow (step S9).

The print inhibition process includes, for example, blinking the warning lamp on the control panel and displaying on the liquid crystal display an error message saying that the installed image forming unit is irregular one thus the printing is inhibited. Accordingly, printing is inhibited when the image forming unit 42 installed in the main component 1*a* is not genuine or the image forming unit 42 still has the transformed (blacked out wholly or partially) label.

The control unit 35 discriminates whether the installed image forming unit is genuine or not, based on the identification label. Therefore, printing is inhibited when the installed image forming unit still has the blacked-out label even if it has fully refilled toner or a replaced new photoconductor drum.

In the process flow shown in FIG. 4A, replacement timing, that is, remaining life of the drum unit 39 is detected based on the counter value of the printed pages. However, a life of the developing unit 41 may be detected by step S3' shown in FIG. 4B instead of step S3. That is, the control unit 35 determines whether toner still remains or not based on information from the toner sensor 36. In this case, step S7 is omitted from the process flow shown in FIG. 4A. If it is determined that the toner is fully exhausted based on the toner sensor 36 (result of step S3' is "NO"), the control unit 35 executes step S8 shown in FIG. 4A.

In a case where the image forming apparatus 1 employs the image forming unit 42 in which the drum unit 39 and the developing unit 41 are combined together, the remaining life of the image forming unit 42 is detectable based on the toner sensor 36. Step S3' (FIG. 4B) may be inserted between steps S3 and S4 (FIG. 4A) to perform life determinations for both drum unit 39 and developing unit 41. The control unit 35 may determine toner consumption in the developing unit 41 based on the counter value. In this case, the toner sensor 36 is unnecessary.

In a case where the drum unit 39 and the developing unit 41 are separately replaceable, the control unit 35 may perform the life determinations for the units separately. In this case, not only the developing unit 41 but also the drum unit 39 requires an identification label on which a predetermined pattern such as the logo mark (trademark logo) is printed. Similar to the logo reader 32 and the heating device 33, sensors for reading the logo marks on the identification labels and devices for transforming them may be provided in the main component 1*a* so as to face to the drum unit 39 and the developing unit 41 respectively.

In the above described embodiment with reference to FIGS. 1A to 4B, the heating device 33 is disposed on the inner surface of the main component 1*a,* however, the heating device and the logo reader may be provided near or in the image forming unit 42 for good use of space or easier installment of the unit. Another embodiment of such the image forming apparatus will now be described.

Figure 5A:
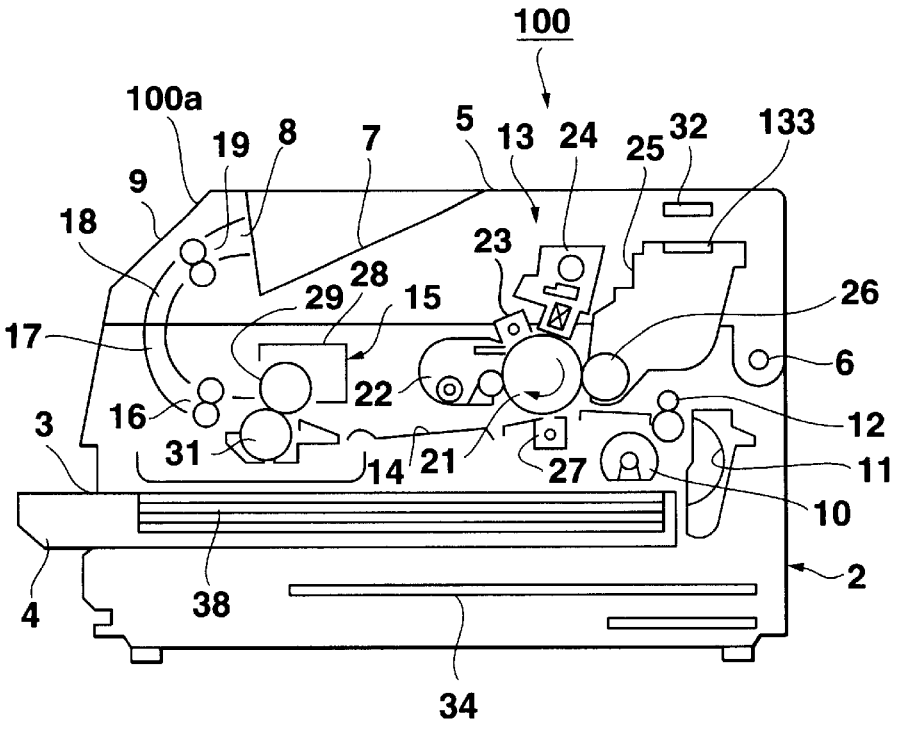
FIG. 5A is a cross sectional view showing the whole structure of an image forming apparatus according to another embodiment of the present invention.
Figure 5B:
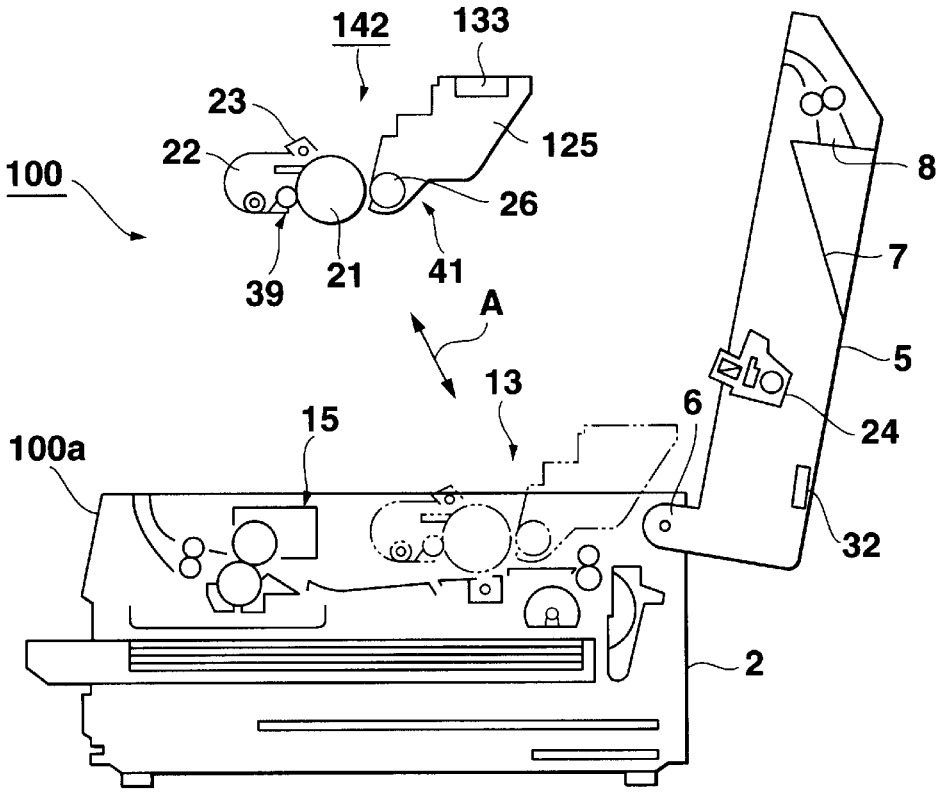
FIG. 5B is a diagram showing the image forming apparatus shown in FIG. 5A when its upper cover is opening for removing/installing an image forming unit.
Figure 6:
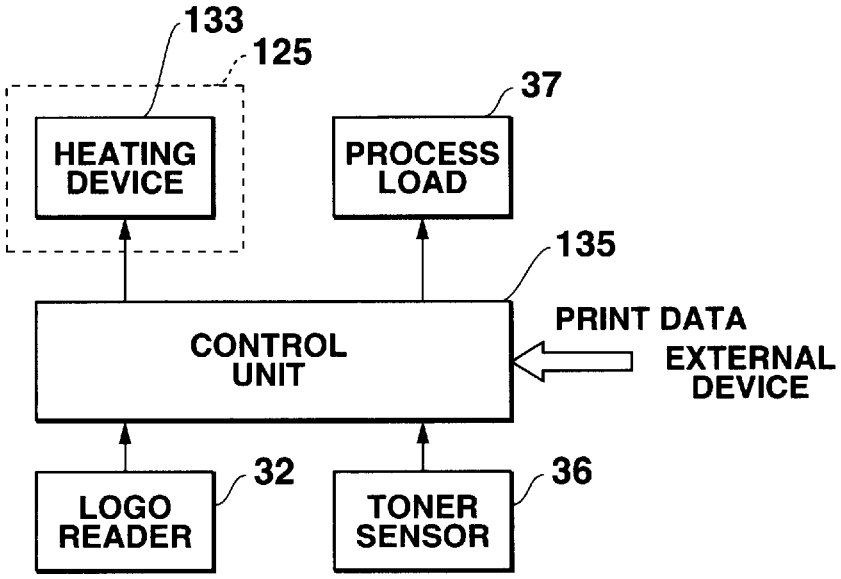
FIG. 6 is a block diagram showing a control unit and its peripheral circuits provided in a circuit unit in the image forming apparatus according to another embodiment of the present invention.
Figure 7:
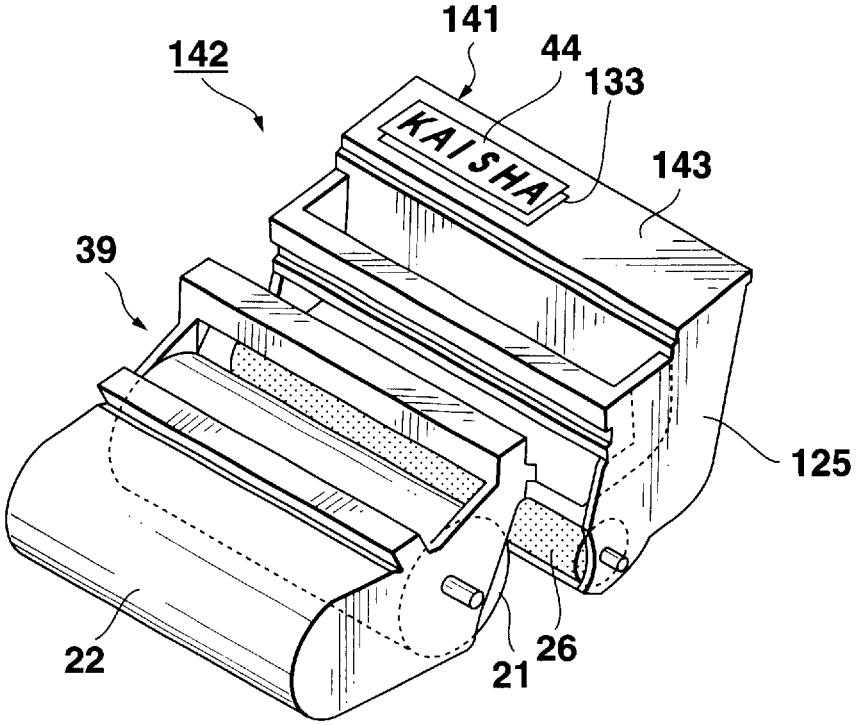
FIG. 7 is a perspective view showing a reusable unit according to another embodiment of the present invention.

FIG. 5A is a cross sectional view showing the whole structure of an image forming apparatus according to another embodiment of the present invention. FIG. 5B shows the image forming apparatus shown in FIG. 5A when its upper cover is opening for removing/installing an image forming unit from/in the image forming apparatus. FIG. 6 is a block diagram showing a control unit and its peripheral circuits in a circuit unit in the image forming apparatus according to another embodiment of the present invention. FIG. 7 is a perspective view showing a reusable unit according to another embodiment of the present invention. Like or the same reference numeral as used in FIGS. 1A to 4B are also used in FIGS. 5A to 7 to denote corresponding or identical components.

As shown in FIGS. 5A and 5B, an image forming apparatus 100 is an electrophotographic printer whose structure is almost the same as that of the aforementioned image forming apparatus 1, except the structure of a developing unit 141 in an image forming unit 142 as the reusable unit and the mechanism near an attachment of the developing unit 141 in a main component 100*a*.

Unlike the developing unit 41, the developing unit 141 comprises a heating device 133 as shown in FIGS. 5A, 5B and 7. The heating device 133 is provided so as to correspond to an identification label 44 affixed on a top surface 143 of a toner hopper 125 to transform the logo mark on the label to unreadable one. That is, while the aforementioned image forming apparatus 1 employs the heating device 33 which is disposed on the inner surface of the main component 1*a* for the logo mark transformation, the image forming apparatus 100 employs the developing unit 141 having the heating device 133 for logo mark transformation.

The heating device 133 comprises a heater buried in the upper surface 143 of the toner hopper 125, and is connected to the control unit 135 via an electrode on the side of the toner hopper 125. That is, the heating device 133 is electrically connected to the control unit 135 when the image forming unit 142 is installed in the main component 100a. The control unit 135 supplies an electric signal to the heating device 133 to drive the heater. To realize this mechanism, the image forming apparatus 100 comprises an electrode and the logo reader 32. The electrode of the image forming apparatus 100 is provided so as to contact the electrode on the toner hopper 125 during the developing unit 141 being installed in the main component 100*a*.

When the image forming unit 142 including the developing unit 141 comes to an end (when the number of print pages reaches the predetermined number, or the toner is fully exhausted), the heating device 133 in the developing unit 141 is driven in accordance with the electric signal from the control unit 135 shown in FIG. 6. The identification label 44 is wholly or partially blacked out by heat from the heating device 133, thus, the logo mark "KAISHA" on the identification label 44 becomes unreadable. The steps to be executed by the control unit 135 are the same as those shown in FIGS. 4A and 4B.

In the image forming apparatus 100, the device such as the heating device 133 for transforming the logo mark on the identification label 44 to unreadable one is provided in the developing unit 141. Thus, the image forming apparatus 100 has better flexibility for designing, especially around attachment of the image forming unit 142 in the main component 100*a,* than the aforementioned image forming apparatus 1. The image forming apparatus 100 also employ other methods for transforming the logo mark. Applying electric energy instead of thermal energy may be applicable. For example, electricity may be applied to the label so as to go through it or charges may be applied onto the label.

In the above described embodiments, discrimination of the logo mark for discriminating the image forming unit 42 or 142 is based on pattern matching. That is, the control unit 35 or 135 compares a pattern read by the logo reader 32 with the previously stored pattern. A simple device for discriminating the installed image forming unit applicable to the image forming apparatus will now be described.

Figure 8A:
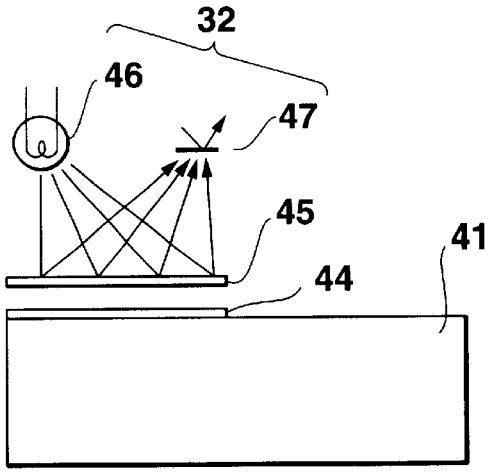
FIG. 8A is a side view schematically showing a positional relationship between an identification label on an image developing unit shown in FIG. 3A and a simplified logo detector according to still another embodiment of the present invention.
Figure 8B:
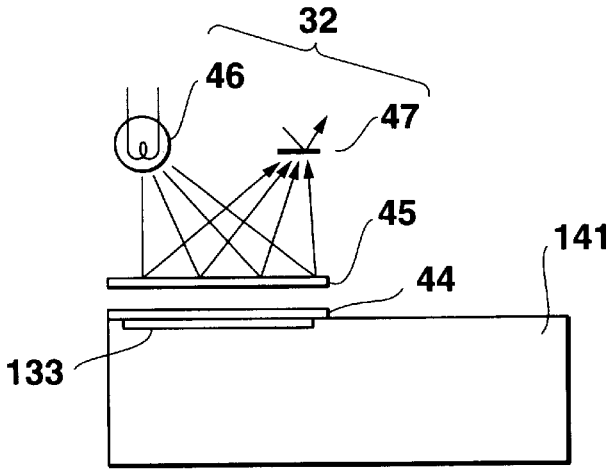
FIG. 8B is a side view schematically exemplifying the simplified logo detector applied to the image developing unit shown in FIG. 7.
Figure 8C:
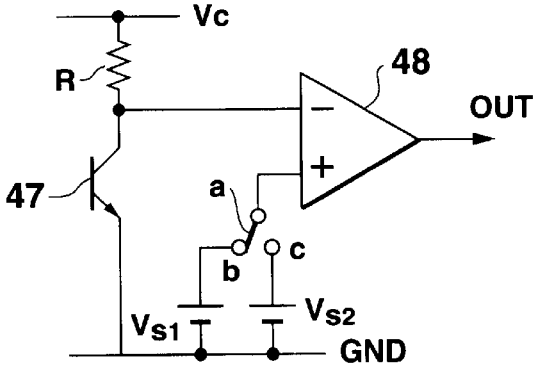
FIG. 8C is a diagram showing the structure of a circuit provided in the logo detector shown in FIGS. 8A and 8B for logo analysis.

FIG. 8A shows a simple logo detector according to a further embodiment of the present invention. FIG. 8A is a side view schematically showing the positional relationship between the identification label 44 on the development unit 41 shown in FIG. 3A and the logo detector. FIG. 8B is a side view schematically exemplifying the simplified logo detector applied to the image developing unit 141 shown in FIG. 7. FIG. 8C is a diagram showing the structure of circuits for analyzing logo provided in the logo detectors shown in FIGS. 8A and 8B.

The circuits for logo analysis shown in FIG. 8C, may be provided in the control unit 35 or 135. Or the logo analyzing circuits may be built in the logo detector and supply an analysis result to the control unit 35 or 135. The control unit 35 or 135 discriminates the logo mark on the identification label 44 based on the received analysis result.

As shown in FIGS. 8A and 8B, the logo detector comprises a light emitter 46, a light receiver 47, and a transparent label 45. When the developing unit 41 or 141 is installed in the main component 1*a* or 100*a,* the transparent label 45 contacts the identification label 44 (In FIGS. 8A and 8B, shown labels are separated for comprehensible explanation, however, those labels contact with each other actually).

A logo reader 32 comprising the above described light emitter 46 and light receiver 47 is placed above the transparent label 45. The logo reader 32 detects all reflected lights from the identification label 44 through the transparent label 45. A voltage corresponding to a reception condition of the lights is input to a negative terminal of a comparator 48 shown in FIG. 8C. A reference potential Vs1 or Vs2 is input to a positive terminal of the comparator 48 via a switch "a".

Figure 9A:
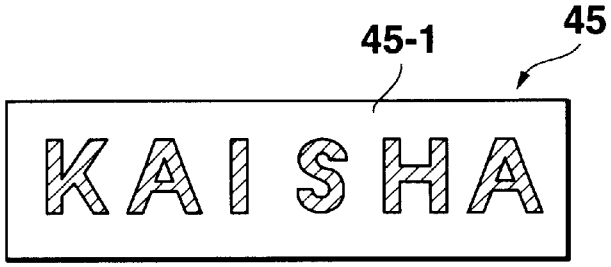
FIG. 9A is a diagram showing a transparent label in the logo detector shown in FIGS. 8A and 8B.
Figure 9B:
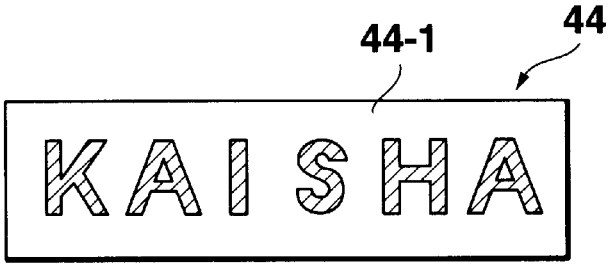
FIG. 9B is an identification label in the image developing unit shown in FIGS. 8A and 8B.
Figure 9C:
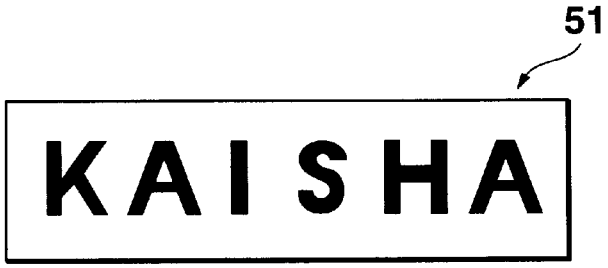
FIG. 9C is a diagram showing a genuine logo mark when the transparent label shown in FIG. 8A and the identification label shown in FIG. 8B are overlapped.
Figure 9D:
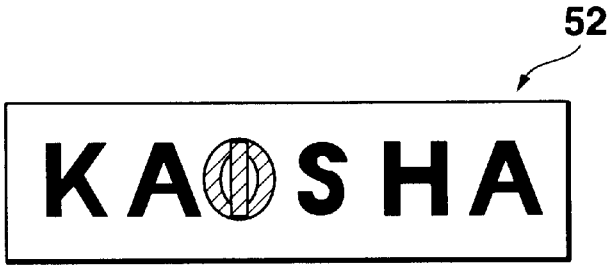
FIG. 9D is a diagram exemplifying an irregular logo mark when the transparent label shown in FIG. 8A and the identification label shown in FIG. 8B are overlapped

FIG. 9A shows the transparent label 45 of the logo detector shown in FIGS. 8A and 8B. FIG. 9B shows the identification label 44 of the developing units 41 and 141 shown in FIGS. 8A and 8B. FIG. 9C shows a n overlaid genuine logo which appears after the transparent label 45 and the genuine identification label 44 are overlaid. FIG. 9D shows an example of an overlaid irregular logo 52 which appears after the transparent label 45 and the irregular identification label 44 are overlaid.

The transparent label 45 shown in FIG. 9A is a transparent plate 45-1 on which the logo mark "KAISHA" is printed with gray letters. In the same manner, the identification label 44 shown in FIG. 9B has a white base 44-1 on which the logo mark "KAISHA" is printed with gray letters. The identification label 44 shown in FIG. 3A or 7 has black letter logo, however, in a case where the above described logo detector is applied, the identification label 44 has gray letter logo. The same font with equaled point (size) is used for printing the logo "KAISHA" on both transparent acrylic plate 45-1 and identification label 44.

The overlaid genuine logo 51 shown in FIG. 9C appears when the image forming unit 42 or 142 on which the genuine identification label 44 is affixed is installed. That is, the overlaid genuine logo 51 is a resultant logo after the genuine identification label 44 and the transparent label 45 are overlaid. In this case, both logos ("KAISHA") completely coincide with each other, thus, the overlaid gray letters become darker, that is, black. The light emitter 46 emits light onto the overlaid genuine logo 51, and the light receiver 47 receives reflection light from the logo 51. The light receiver 47 comprises active elements in which a resistance value varies in accordance with the received light amount. A resultant voltage after dividing a source voltage Vc by a resistor R and the light receiver 47 is input to the negative input terminal of the comparator 48 shown in FIG. 8C.

If the identification label 44 has an irregular logo mark "KAOSHA" as shown in FIG. 9D, first two letters "KA" and last three letters "SHA" of the transparent label 45 and the identification label 44 completely coincide with each other, thus, those letters of the overlaid irregular logo 52 are seemed black. As for the third letter of the logo mark, however, a correct letter "I" on the transparent label 45 and an irregular letter "O" on the identification label 44 do not coincide completely with each other, thus, a resultant letter after those letters are overlaid has both black portions and gray portions. In this case, the overlaid irregular logo 52 has less black portions than the overlaid genuine logo 51 because of the gray portions (that is, the logo 52 is lighter than the logo 51). As a result, amount of reflex light from the overlaid irregular logo 52 is larger than the case of the overlaid genuine logo 51.

The reference potential Vs2 shown in FIG. 8C should be set to a voltage corresponding to reflection light amount which is slightly less than whole amount of the reflection light from the overlaid genuine logo 51. In a case of genuine logo 51 or irregular logo 52 having larger reflection light amount than regular amount, an output signal from the output terminal OUT of the comparator 48 is high level (H) when the switch "a" is switched to the terminal "c".

On the contrary, in a case where the identification label 44 has other gray and black portions on other areas than "KAISHA", or the identification label 44 is blacked out to indicate that the developing unit 41 or 141 has been come to an end, the reflection light amount from the irregular logo 52 is less than that from the genuine logo 51.

The reference potential Vs1 shown in FIG. 8C should be set to a voltage corresponding to reflection light amount which is slightly larger than whole amount of the reflection light from the overlaid genuine logo 51. In a case of genuine logo 51 or irregular logo 52 having less reflection light amount than regular amount, an output signal from the output terminal OUT of the comparator 48 is low level (L) when the switch "a" is switched to the terminal "b".

In conclusion, it is detectable whether the resultant logo is genuine (logo 51) or irregular (logo 52) based on a combination of the signal levels of the output signal from the output terminal OUT of the comparator 48 after the switch "a" is switched alternately. The relationship between the darkness of the label and the signal levels will be shown in the following table 1.

TABLE 1

| | SWITCH a | |
|---|---|---|
| | TERMINAL b | TERMINAL c |
| DARKER THAN GENUINE LABEL | L | L |
| GENUINE LABEL | L | H |
| LIGHTER THAN GENUINE LABEL | H | H |

As shown in table 1, the overlaid genuine logo 51 results only the case where the signal level is low when the switch "a" is switched to the terminal "b" while the level is high when the switch "a" is switched to the terminal "c". Therefore, it is determined that the identification label 44 on the installed developing unit 41 or 141 is genuine one when the above combination is obtained.

Accordingly, in the image forming apparatus according to the further embodiment of the present invention, the control unit 35 or 135 discriminates whether the image forming unit 42 or 142 installed in the main component 1*a* or 100*a* is genuine one or not in accordance with the amount of the reflection light from the resultant logo after the identification label 44 and the transparent label 45 are overlaid with each other. This discrimination method employed in the image forming apparatus according to the further embodiment provides easier solution for discriminating whether the installed image forming unit 42 or 142 is genuine or not, thus, the image forming apparatus according to this embodiment is more practical.

Such the light based discrimination may be done partially. That is, the light emitter 46 may emit lights toward predetermined areas on the overlapped logo mark respectively. In this case, the control unit 35 or 135 detects irregular identification label 44 when the control unit 35 or 135 detects any one of areas which does not show the L-H combination of the output signal level from the comparator 48 or the number of such areas exceeds a predetermined threshold. When the irregular identification label 44 is found by the above manner, the printing operation is inhibited.

In the above described embodiments, the energy applying device such as the heating device 33 or 133 applies energy to the identification label 44 made of a material which will be discolored (blacked out) by the applied energy to transform the identification label 44 to unreadable one. The identification label 44 may be made of ordinal material such as non-thermosensitive paper, plastic sheet, if the identification label 44 can be transformed to unreadable one by any other means. An image forming apparatus according to a still another embodiment will now be described with reference to FIGS. 1A to 4B.

Figure 10A:
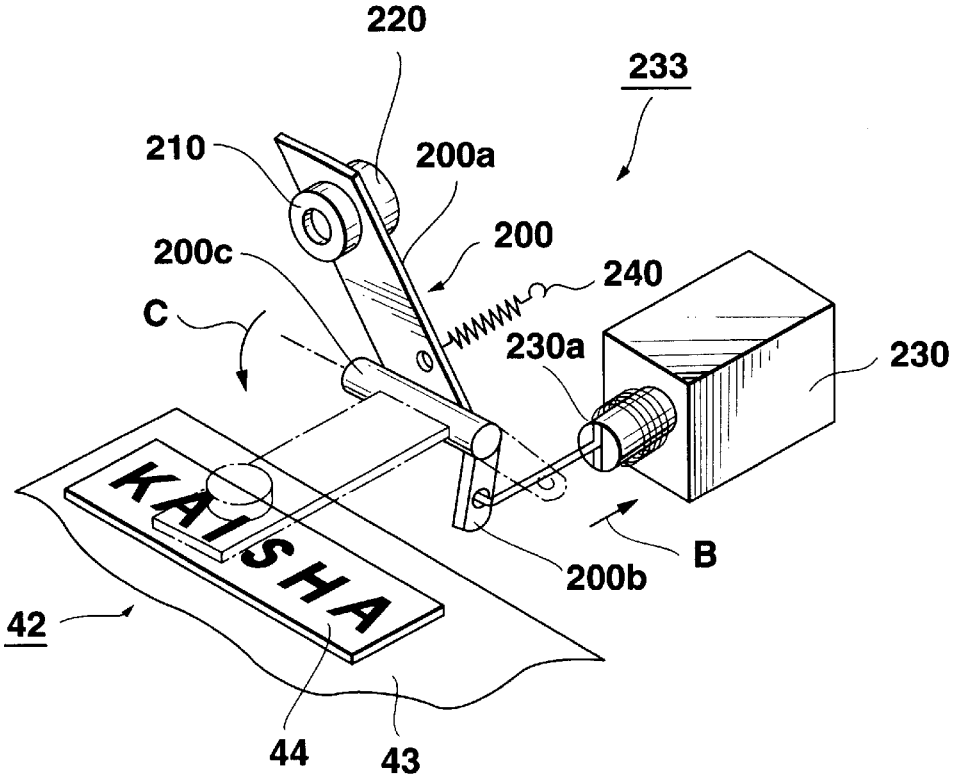
FIG. 10A is a diagram exemplifying a solenoid stamper.
Figure 10B:
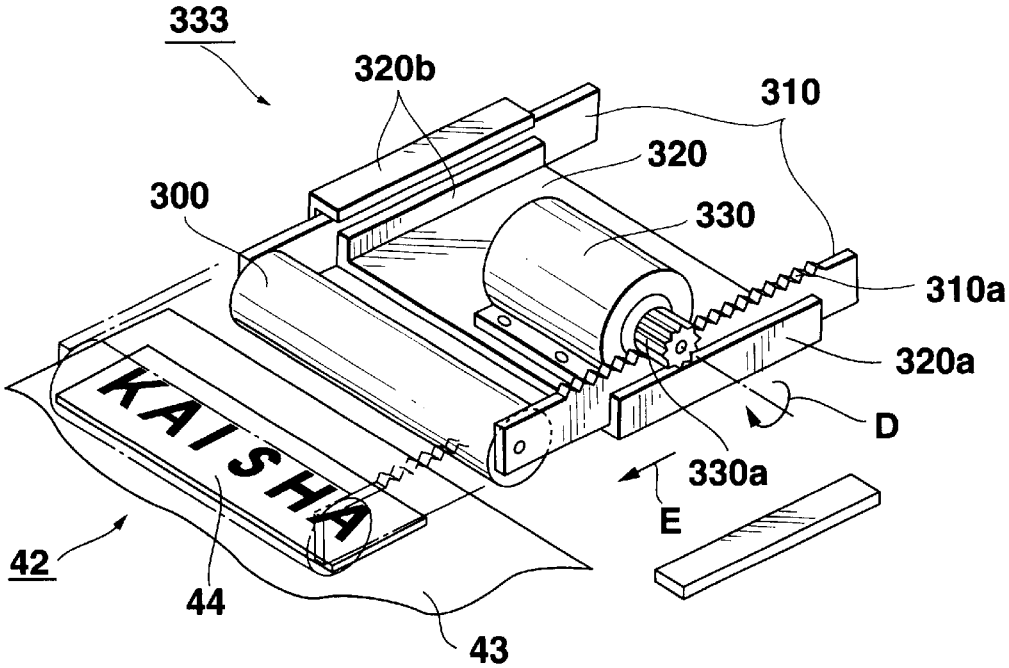
FIG. 10B is a diagram exemplifying a roller stamper.

In an image forming apparatus shown in FIGS. 10A to 10B, for example, an ordinal label on which the logo mark (trademark logo) "KAISHA" is printed as a predetermined pattern is used as the identification label 44 to be affixed on the image forming unit 42. Instead of the heating device 33, a device which applies a pigment such as an ink onto the identification label 44 to transform it to unreadable one is provided in the main component 1*a*.

For example, a stamper which is pre-inked with indelible ink may be applicable as the device for applying the pigments such as the ink. A solenoid stamper 233 shown in FIG. 10A or a roller stamper 333 shown in FIG. 10B may be applicable as the stamper.

As shown in FIG. 10A with solid lines, the solenoid stamper 233 comprises an arm-like member 200, a solenoid 230, etc. The arm-like member 200 has an arm 200*a* and a lever 200*b* which are unified on a shaft 200*c*. The arm-like member 200 is rotatably suspended by a suspension mechanism. The solenoid 230 comprises a plunger 230*a* which is connected to the lever 200*b* of the arm-like member 200. An ink pot 220 and a stamp head 210 for transferring ink in the ink pot 220 are prepared at a movable end of the arm-like member 200. The solid line drawing shown in FIG. 10A represents stand-by position of the arm-like member 200. That is, enforcement given by a spring 240 keeps the stand-by position. When the solenoid 230 is driven by a signal from a control unit (which is similar the control unit 35 shown in FIG. 2), the plunger 230*a* and the lever 200*b* are pulled in the direction indicated by an arrow B, thus, the movable end of the arm-like member 200 rotates in the direction indicated by an arrow C. As a result, the arm-like member 200 is moved to a stamping position represented by a chain line drawing in FIG. 10A. That is, the stamp head 210 contacts the identification label 44 and the ink to the identification label 44.

On the contrary, the roller stamper 333 comprises a pre-inked porous elastic roller 300, an arm unit 310 for holding the porous roller 300, a base unit 320 having rails 320*a* and 320*b* which slidably hold the arm unit 310, and a motor 330 which is fixed on the base unit 320 and is able to rotate back and forth, as shown in FIG. 10B. A rack 310*a* is formed on an upper surface of one arm of the arm unit 310, and the motor 330 has a pinion 330*a*. The rack 310*a* and the pinion 330*a* are geared each other. When the motor 330 rotates in the direction indicated by an arrow D for a predetermined period of time in accordance with a signal given by a control unit (which is similar the control unit 35 shown in FIG. 2), the arm unit 310 slides in the direction indicated by an arrow E by traction force via the pinion 330*a* and the rack 310*a*. Thus, the porous elastic roller 300 contacts the identification label 44, and the ink is applied onto the identification label 44. The above described logo reader 32 or the simple structured logo detector is arranged in the main component 1*a*. An ink-jet printing head may be applicable as the device for applying the pigment onto the identification label 44.

When a control unit similar to the control unit 35 determines that the above described image forming unit 42 no longer works, the control unit outputs a predetermined signal to the device for applying the pigment to drive it. Thus, the identification label 44 is painted with the pigment such as the indelible ink, so that the logo mark "KAISHA" on the identification label 44 becomes unreadable. The pigment applying device may apply the ink onto the identification label 44 with touch-and-slide movement (FIG.10B) or just stamping (FIG.10A). In such the image forming apparatus, steps executed by the control unit are substantially the same as those shown in FIGS. 4A and 4B.

In the case of applying the pigment to transform the label, the apparatus becomes more practical because various materials are applicable to the identification label 44.

Accordingly, each of the image forming apparatuses 1 and 100 according to the above embodiments employs the structure including a combination of the identification label 44 on which a predetermined pattern such as the logo mark (trademark logo) is printed, the device for detecting the predetermined pattern (the logo reader 32, etc.), and the pattern transformer (the heating device 33, 133, etc.). According to this combination structure, the control unit 35 or 135 can determine whether the image forming unit 42 being installed in the main component 1*a* or 100*a* is genuine or not. The control unit 35 or 135 executes image formation onto the sheet 38 when the image forming unit is genuine, while inhibiting the execution when the image forming unit is irregular one.

Since copying the identification label 44 and using it by a third party may constitute trademark infringement, the usage of copied labels is inhibited substantially. Moreover, image formation onto the sheet 38 is also inhibited when the image forming unit 42 has irregular identification label. Therefore, copy or reuse products with crude quality causing image quality deterioration are eliminated from the market. Since only the genuine product (image forming unit) is used, the number of problems caused by the image forming unit is reduced, moreover, easy trouble shooting is realized even if the unit has a problem. As a result, the product and its manufacturer gain consumer confidence.

The genuine manufacturer can produce and provide high quality reused products, that is, toner and a photoconductive drum to be used in their reused image forming unit 42 or 142 has the quality same as that of brand new products. Therefore, problems such as image quality deterioration seldom occur although the image forming unit is reused product. Moreover, it is easy to find out causes of trouble even if the unit has a problem.

Unlike crude irregular products, refilling the toner and replacement of the photoconductor drum do not cause trouble in the image forming apparatus 1 or 100. The manufacturer of the image forming apparatus can design and produce image forming units which are reusable with refilling and replacing, thus the image forming apparatus 1 or 100 realize less waste emission.

Only authorized manufacturers of the image forming unit are allowed to replace a transformed identification label with new one. Since the control unit 35 or 135 determines that the reused image forming unit 42 or 142 having the new identification label is genuine one, there is no inhibition for printing.

In the above embodiments, the control unit 35 or 135 determines a life of the image forming unit 42 or 142 based on the number of printed pages or remained toner. However, the way to determine the life is not limited to that. For example, the image forming unit 42 or 142 may have a label indicating its term of validity, and the control unit 35 or 135 may determine that the image forming unit 42 or 142 no longer works when an internal timer coincides with the term of validity.

Instead of identification label 44, moreover, a computer readable recording medium storing predetermined data representing a predetermined pattern may be applicable. In this case, the control unit 35 or 135 discriminates whether the data stored in the recording medium coincide with predetermined data to determine whether the installed image forming unit 42 or 142 is genuine or not.

An EPROM (UV-EPROM) whose data is erasable by an ultraviolet ray or an EEPROM whose data is electrically erasable may be applicable as the above described recording medium.

A magnetic recording medium or a magneto-optical recording medium may be applicable as the above described recording medium.

The magnetic recording medium or the magneto-optical recording medium itself may be broken (cut, drilled). In the case where the above described recording medium is used instead of the identification label 44, data to be stored in the recording medium as the predetermined pattern may be whole or a part of a program which controls the image forming apparatus 1 or 100 to perform image forming. The control unit 35 or 135 may rewrite the program stored in the recording medium so as to be no longer executed or erase the program when it is determined that the image forming unit 42 or 142 no longer works. Or, breaking the recording medium may be applicable. Thus, an irregularly copied or reused image forming unit does not have a recording medium storing genuine programs. As a result, usage of such the image forming unit is inhibited. Moreover, since copying the program may constitute copyright infringement, copying or reusing the image forming unit by a third party is substantially inhibited.

In the above embodiment, an electrophotographic printer is exemplified, however, the present invention is applicable to any type of printer having a rechargeable unit, such as an ink-jet printer using ink as an expendable material and an ink cartridge, a thermal printer and a dot-matrix printer and their expendable ribbon cartridges. The present invention, moreover, is applicable to not only a printer but also any other image forming apparatus such as a copying machine or a facsimile machine.

This application is based on Japanese Patent Application Nos. H10-368704 filed on Dec. 25, 1998 and H11-150301 filed on May 28, 1999. The entire contents of the above mentioned Japanese Patent Applications are incorporated herein by reference in their entirety.

What is claimed is:

1. A reusable unit that is adapted to be detachably installed in an image forming apparatus and to contain an expendable element that is exhaustible by the image forming apparatus, said reusable unit comprising:

a display medium on which a specific pattern to be read by a reader in said image forming apparatus is displayed;

wherein said specific pattern represents a trademark and said image forming apparatus is enabled to execute an image forming operation only when the specific pattern read by said reader is recognized as the trademark;

wherein the display medium is formed of a material that is adapted to be modified so as to render the specific pattern displayed on the display medium illegible; and wherein said reusable unit is adapted to be refilled with more of the expendable element or to contain a new expendable element after exhaustion of the expendable element by the image forming apparatus.

2. The reusable unit according to claim 1, wherein said display medium is adapted to be modified so as to render the specific pattern displayed thereon illegible when energy is supplied from said image forming apparatus.

3. The reusable unit according to claim 1, wherein said display medium is adapted to be modified so as to render the specific pattern displayed thereon illegible based on a signal supplied from said image forming apparatus.

4. The reusable unit according to claim 1, wherein said display medium is adapted to be discolored by heat applied thereto so as to render the specific pattern displayed thereon illegible.

5. The reusable unit according to claim 1, wherein said display medium is adapted to be discolored by electricity applied thereto so as to render the specific pattern displayed thereon illegible.

6. The reusable unit according to claim 1, wherein said display medium is adapted to be discolored by a charge applied thereto so as to render the specific pattern displayed thereon illegible.

7. An image forming apparatus in which a reusable unit may be detachably installed, wherein said reusable unit contains an expendable element that is exhaustible by the image forming apparatus, and said reusable unit comprises a display medium on which a specific pattern is printed, said image forming apparatus comprising:

a reader that reads the specific pattern printed on said display medium;

a pattern processor adapted to cause the specific pattern printed on said display medium to be rendered illegible; and a control unit that determines whether the specific pattern read by said reader coincides with a predetermined trademark, and that enables said image forming apparatus to execute an image forming operation only when the specific pattern read by the reader coincides with the predetermined trademark;

wherein said reusable unit is adapted to be refilled with more of the expendable element or to contain a new expendable element after exhaustion of the expendable element by the image forming apparatus.

8. The image forming apparatus according to claim 7, further comprising a detector that determines whether the expendable element contained in the reusable unit is exhausted by the image forming apparatus, and wherein said control unit activates said pattern processor to cause the specific pattern printed on said display medium to be rendered illegible when the expendable element contained in the reusable unit is determined to be exhausted.

9. The image forming apparatus according to claim 7, wherein said display medium comprises a material that is adapted to be discolored by externally supplied heat, and said pattern processor comprises a heating device that applies thermal energy to said display medium so as to render the specific pattern printed on the display medium illegible.

10. The image forming apparatus according to claim 7, wherein said display medium comprises a material that is adapted to be discolored when electricity is applied thereto, and said pattern processor comprises an electricity supply that applies electricity to said display medium so as to render the specific pattern printed on the display medium illegible.

11. The image forming apparatus according to claim 7, wherein said display medium comprises a material that is adapted to be discolored when a charge is applied thereto, and said pattern processor comprises a discharging device that applies a charge to said display medium so as to render the specific pattern printed on the display medium illegible.

12. An image forming apparatus in which a reusable unit may be detachably installed, wherein said reusable unit contains an expendable element that is exhaustible by the image forming apparatus, and said reusable unit comprises a display medium on which a specific pattern is printed and a pattern processor adapted to cause the specific pattern printed on said display medium to be rendered illegible, said image forming apparatus comprising:

a reader that reads the specific pattern printed on said display medium; and a control unit that determines whether the specific pattern read by said reader coincides with a predetermined trademark, and that enables said image forming apparatus to execute an image forming operation only when the specific pattern read by the reader coincides with the predetermined trademark;

wherein said reusable unit is adapted to be refilled with more of the expendable element or to contain a new expendable element after exhaustion of the expendable element by the image forming apparatus.

13. The image forming apparatus according to claim 12, further comprising a detector that determines whether the expendable element contained in the reusable unit is exhausted by the image forming apparatus, and wherein said control unit activates said pattern processor to cause the specific pattern printed on said display medium to be rendered illegible when the expendable element contained in the reusable unit is determined to be exhausted.

14. The image forming apparatus according to claim 12, wherein said display medium comprises a material that is adapted to be discolored by externally supplied heat, and said pattern processor comprises a heating device that applies thermal energy to said display medium so as to render the specific pattern printed on the display medium illegible.

15. The image forming apparatus according to claim 12, wherein said display medium comprises a material that is adapted to be discolored when electricity is applied thereto, and said pattern processor comprises an electricity supply that applies electricity to said display medium so as to render the specific pattern printed on the display medium illegible.

16. The image forming apparatus according to claim 12, wherein said display medium comprises a material that is adapted to be discolored when a charge is applied thereto, and said pattern processor comprises a discharging device that applies a charge to said display medium so as to render the specific pattern printed on the display medium illegible.

17. An image forming apparatus in which a reusable unit may be detachably installed, wherein said reusable unit contains an expendable element that is exhaustible by the image forming apparatus, and said reusable unit comprises a display medium on which a specific pattern is printed, said image forming apparatus comprising:

a reader that reads the specific pattern printed on said display medium;

a pattern processor adapted to cause the specific pattern printed on said display medium to be rendered illegible by applying pigment onto the specific pattern; and a control unit that determines whether the specific pattern read by said reader coincides with a predetermined trademark, and that enables said image forming apparatus to execute an image forming operation only when the specific pattern read by the reader coincides with the predetermined trademark;

wherein said reusable unit is adapted to be refilled with more of the expendable element or to contain a new expendable element after exhaustion of the expendable element by the image forming apparatus.

18. The image forming apparatus according to claim 17, further comprising a detector that determines whether the expendable element contained in the reusable unit is exhausted by the image forming apparatus, and wherein said control unit activates said pattern processor to cause the specific pattern printed on said display medium to be rendered illegible when the expendable element contained in the reusable unit is determined to be exhausted.

19. The image forming apparatus according to claim 17, wherein said pattern processor comprises a stamper that applies the pigment onto the specific pattern printed on said display medium.

20. A reusable unit that is adapted to be detachably installed in an image forming apparatus and to contain an expendable element that is exhaustible by the image forming apparatus, said reusable unit comprising:

a display medium on which a specific pattern to be read by a reader in said image forming apparatus is displayed;

wherein said image forming apparatus is enabled to execute an image forming operation only when the specific pattern read by said reader is recognized as matching a predetermined pattern;

wherein the display medium is formed of a material that is adapted to be modified so as to render the specific pattern displayed on the display medium illegible when the expendable element contained in the reusable unit is exhausted; and wherein said reusable unit is adapted to be refilled with more of the expendable element or to contain a new expendable element after exhaustion of the expendable element by the image forming apparatus.

* * * * *